US005974826A

United States Patent [19]

Baldwin et al.

[11] Patent Number: 5,974,826

[45] Date of Patent: Nov. 2, 1999

[54] BEVERAGE COOLING AND CARRYING APPARATUS AND METHOD FOR COOLING AND CARRYING BEVERAGE

[75] Inventors: Wayne D. Baldwin, Asheboro; Morona D. Routh, Randleman, both of N.C.

[73] Assignee: Vesture Corporation, Asheboro, N.C.

[21] Appl. No.: 09/070,684

[22] Filed: Apr. 30, 1998

[51] Int. Cl.[6] ..... F25D 3/08

[52] U.S. Cl. ..... 62/457.2; 62/457.4; 62/457.5; 62/457.8

[58] Field of Search ..... 62/457.2, 457.4, 62/457.5, 457.8

[56] References Cited

U.S. PATENT DOCUMENTS

| | | | |
|---|---|---|---|
| D. 343,088 | 1/1994 | Owens . | |
| D. 346,062 | 4/1994 | Owens . | |
| 3,974,658 | 8/1976 | Starrett . | |
| 3,998,072 | 12/1976 | Shaw . | |
| 4,019,340 | 4/1977 | Conklin . | |
| 4,383,422 | 5/1983 | Gordon et al. . | |
| 4,388,813 | 6/1983 | Gardner et al. . | |
| 4,393,665 | 7/1983 | Gardner et al. . | |
| 4,531,381 | 7/1985 | Toro et al. | 62/372 |
| 4,812,054 | 3/1989 | Kirkendall . | |
| 4,819,793 | 4/1989 | Willard et al. | 206/162 |
| 4,858,444 | 8/1989 | Scott | 62/372 |
| 4,899,904 | 2/1990 | Dooley et al. | 220/413 |
| 5,005,374 | 4/1991 | Spitler . | |
| 5,241,835 | 9/1993 | Ascone . | |
| 5,300,105 | 4/1994 | Owens . | |
| 5,339,541 | 8/1994 | Owens . | |
| 5,357,693 | 10/1994 | Owens . | |
| 5,421,172 | 6/1995 | Jones . | |
| 5,500,010 | 3/1996 | Owens . | |
| 5,545,198 | 8/1996 | Owens . | |
| 5,570,588 | 11/1996 | Lowe . | |
| 5,575,812 | 11/1996 | Owens . | |
| 5,591,221 | 1/1997 | Owens . | |
| 5,601,744 | 2/1997 | Baldwin . | |
| 5,630,959 | 5/1997 | Owens . | |
| 5,676,296 | 10/1997 | Masters | 224/653 |
| 5,700,284 | 12/1997 | Owens . | |

*Primary Examiner*—Henry Bennett
*Assistant Examiner*—Mark Shulman
*Attorney, Agent, or Firm*—Merchant & Gould P.C.

[57] ABSTRACT

A beverage cooling and carrying apparatus is described. The beverage cooling and carrying apparatus includes a first compartment and a second compartment. The first compartment includes an area constructed for receiving a beverage and a heat sink, a door for selective access to the first compartment, and insulation for decreasing the rate of heat transfer into the first compartment. The second compartment is provided for receiving drinking containers, and includes cushioning material. The apparatus includes a strap for carrying the apparatus. The beverage cooling and carrying apparatus preferably includes a bottle of wine in the first compartment, and a pair of wine glasses in the second compartment. A method for cooling and carrying beverage is provided by the present invention.

16 Claims, 3 Drawing Sheets

BEVERAGE COOLING AND CARRYING APPARATUS AND METHOD FOR COOLING AND CARRYING BEVERAGE

FIELD OF THE INVENTION

The present invention relates to a beverage cooling and transporting apparatus and to a method for cooling and carrying beverage.

BACKGROUND OF THE INVENTION

Various insulated beverage containers for holding beverages and keeping them cool are known. Exemplary types of containers are described by U.S. Pat. Nos. 5,570,588 to Lowe; 5,421,172 to Jones; 5,241,835 to Ascome; 4,812,054 to Kirkendall; 3,998,072 to Shaw; 4,383,422 to Gordon et al.; 4,388,813 to Gardner et al.; 5,005,374 to Spitler; 4,393,665 to Gardner et al.; 3,974,658 to Starratt; and 4,019,340 to Conklin.

SUMMARY OF THE INVENTION

The invention relates to a beverage cooling and carrying apparatus including a first compartment and a second compartment. The first compartment includes an area constructed for receiving a beverage and a heat sink, a door for selective access to the first compartment, and insulation for decreasing the rate of heat transfer into the first compartment. The second compartment is provided for receiving drinking containers, and includes cushioning material. The apparatus includes a strap for carrying the apparatus.

The beverage cooling and carrying apparatus preferably includes a bottle of wine in the first compartment, and a pair of wine glasses in the second compartment. Preferably, the wine glasses are strapped into the second compartment to reduce movement of the wine glasses. The second compartment can additionally include napkins strapped therein and a corkscrew strapped therein.

A method for cooling and carrying beverage is provided by the present invention. The method includes steps of providing an apparatus for cooling and carrying beverage, cooling the heat sink to a temperature of less than about 36° F., and placing the heat sink within the sack in the first compartment. Preferably, a bottle of wine is placed in the first compartment along with the heat sink, and wine glasses are placed in the second compartment.

DETAILED DESCRIPTION OF THE PREFERRED EMBODIMENT

Figure 1:
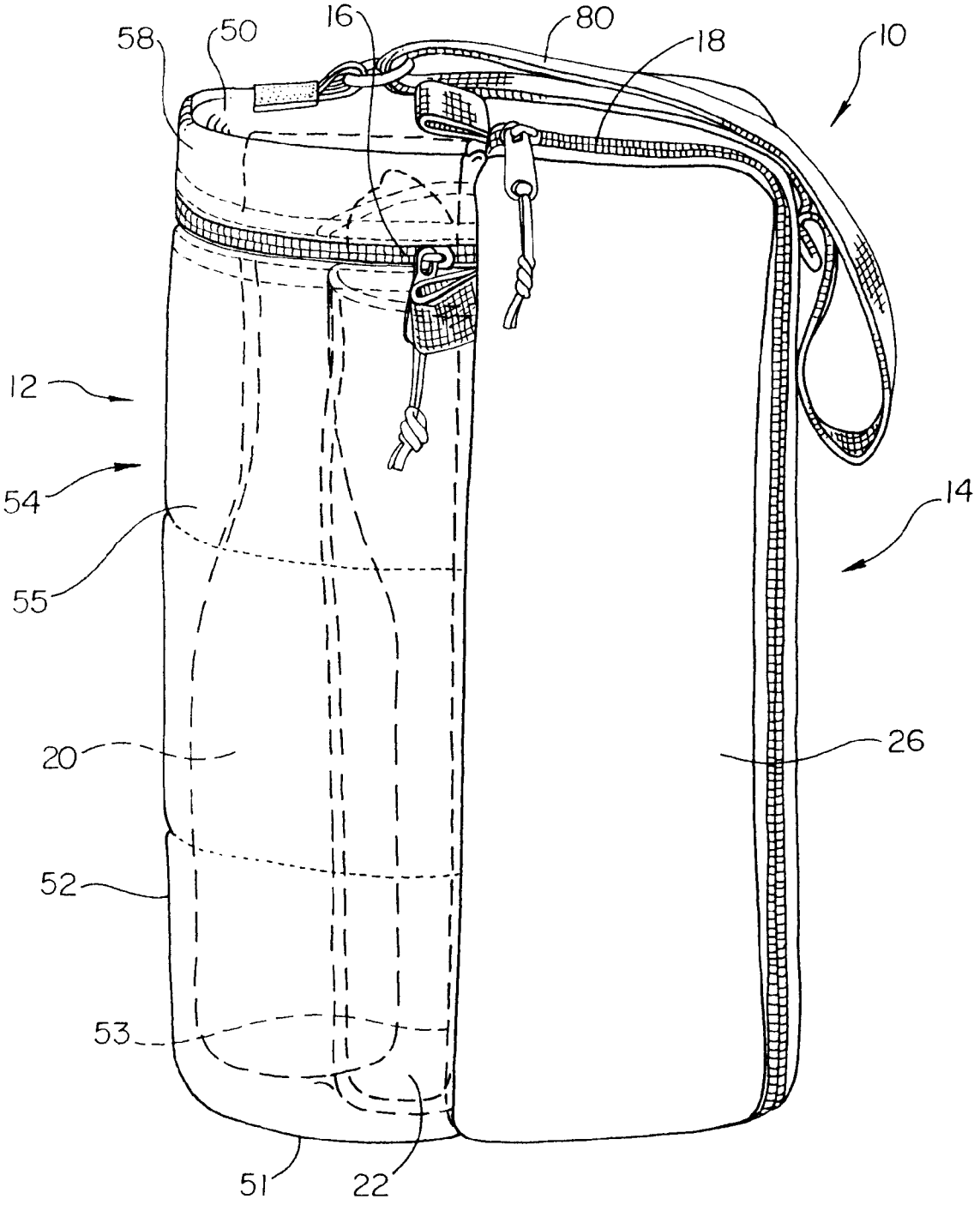
FIG. 1 is a perspective view of a beverage cooling and carrying apparatus according to the principles of the present invention.
Figure 2:
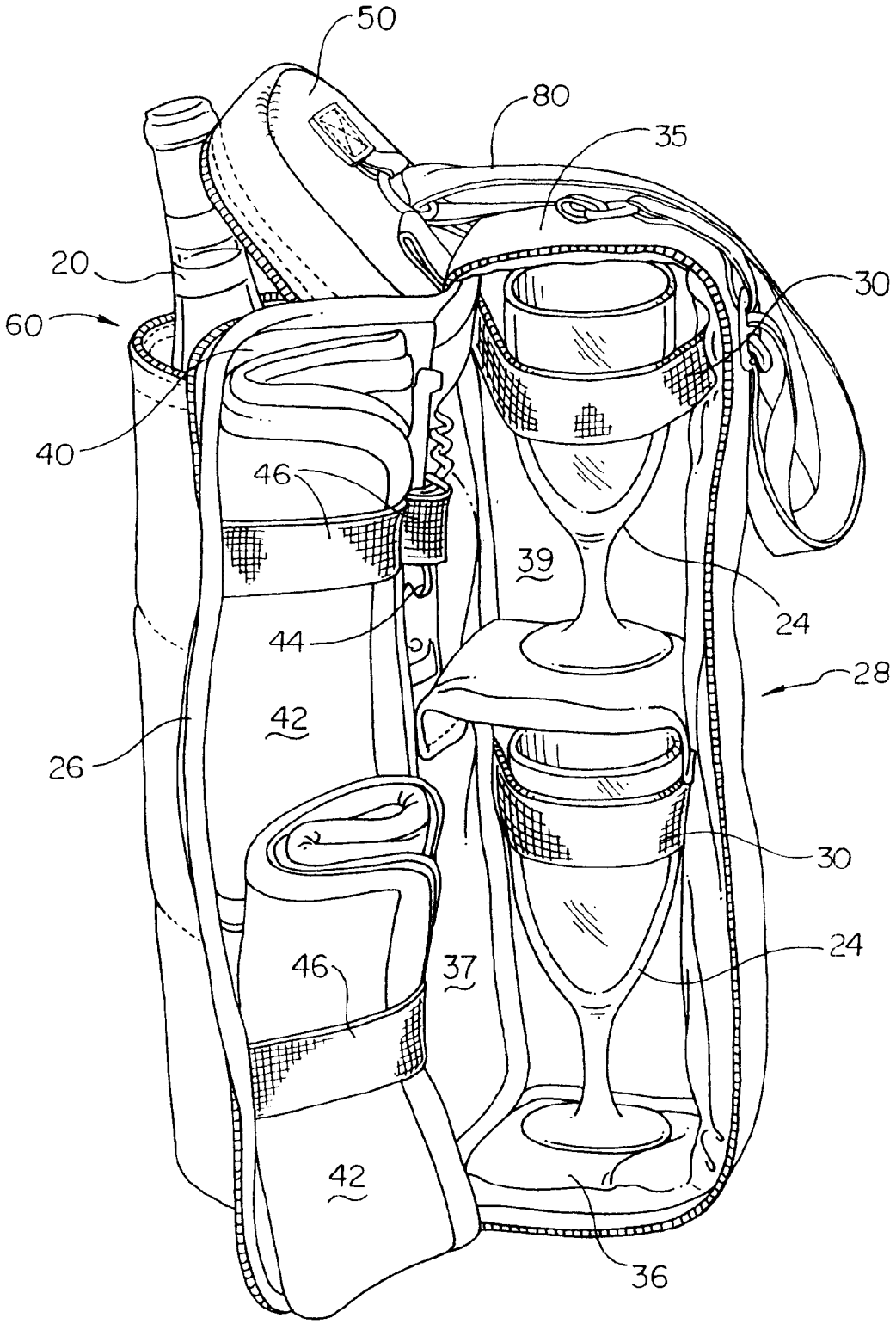
FIG. 2 is a perspective view of the beverage cooling and carrying apparatus of FIG. 1 wherein the beverage container compartment 12 and the drinking container compartment 14 are shown in an open position.
Figure 3:
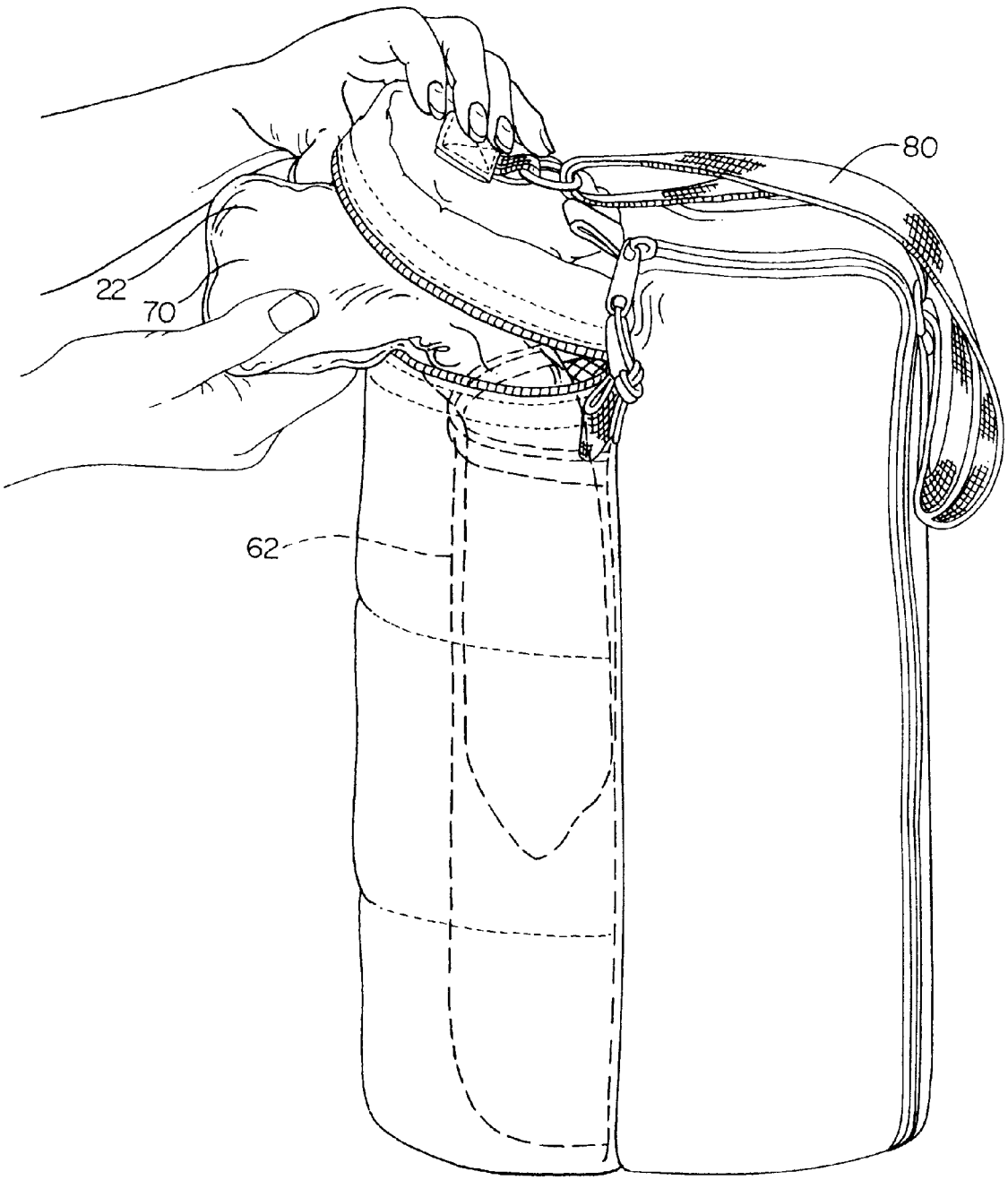
FIG. 3 is a perspective view of the beverage cooling and carrying apparatus of FIG. 1, wherein the heat sink unit is shown being inserted into the beverage container compartment 12.

Referring to FIGS. 1–3, a beverage cooling and carrying apparatus according to the present invention is shown at reference numeral 10. The beverage cooling and carrying apparatus is provided for keeping a container of beverage cool for an extended period of time. A preferred type of beverage which can be kept cool by the apparatus of the invention is wine. The beverage cooling and transporting apparatus 10 can be referred to as the tote.

The tote 10 includes two general compartments. The first compartment may be referred to as the beverage cooling compartment 12, and the second compartment can be referred to as the drinking container compartment 14. Both compartments are selectively openable or closable. The beverage cooling compartment 12 includes a zipper 16 for providing access to the beverage 20 and the heat sink 22 provided therein. The drinking container compartment 14 includes a zipper 18 for providing access to the drinking containers 24 provided therein.

The drinking container compartment 14 includes a door 26 which opens and closes, and an interior area 28 for holding at least two drinking containers 24. In the preferred embodiment, the drinking containers 24 are wine glasses. The drinking containers 24 are held in place by straps 30 which are preferably elastic straps. The drinking containers 24 are preferably separated by a baffle 32 to prevent the drinking containers 24 from contacting each other. In the case of wine glasses, it is important to keep the wine glasses from contacting each other and breaking.

The drinking container compartment 14 includes a top wall 35, a bottom wall 36, a left side wall 37, a right side wall 38, a back wall 39, and a front wall 40. It is the front wall 40 which forms the door 26. Preferably, the walls of the drinking container compartment 14 are cushioned to prevent breakage of the drinking containers 20. Preferably, the left side wall 37 includes thermal insulation to reduce heat transfer into the beverage cooling compartment 12. The materials and manufacturing techniques used to manufacture the drinking container compartment 14 are known.

Additionally included within the drinking container compartment 14 are napkins 42 and a corkscrew 44. These components are preferably held in place by elastic straps 46.

The beverage cooling compartment 12 includes a top wall 50, a bottom wall 51, a left side wall 52, a right side wall 53, a back wall 54, and a front wall 55. The top wall 50 forms the top door 58 which provides for selective access into the beverage cooling compartment 12. Preferably, all of the walls include insulation to reduce heat transfer into the beverage cooling compartment 12.

The beverage cooling compartment 12 includes an area 60 for receiving both the beverage 20 and the heat sink 22. The beverage container 20 is preferably a bottle of wine. Accordingly, the beverage cooling compartment is preferably constructed of a size which is sufficient to accommodate a conventional size wine bottle and the heat sink 22. The beverage cooling compartment 12 additionally includes a sack 62 for receiving and holding the heat sink 22 in place. The sack 62 is preferably a material which allows heat to rapidly transfer from the beverage 20 to the heat sink 22. Preferably, the sack 62 is a net or mesh material.

The heat sink 22 is provided as the source for removing heat from the beverage 20 and keeping the beverage cool for an extended period of time. For example, the heat sink 22, when provided at a temperature of about 36° F., will provide a 750 ml bottle of wine, originally provided at a temperature of about 80° F., at a temperature of about 65° F. after 30 minutes when the tote is kept at room temperature. The heat sink 22 includes a sealed envelope 70 containing a thermal retention fluid. The thermal retention fluid can be cooled by placement in a refrigerator or freezer. The heat sink 22 can be manufactured according to U.S. Pat. No. 5,630,959 to Owens, the entire disclosure of which is incorporated herein by reference. Furthermore, the heat sink 22 can be purchased from Vesture Corporation under the mark Microcore®. It should be appreciated that various other types of heat sinks can be used provided that they are flexible and are capable of being cooled in a refrigerator or freezer. It is generally preferred, however, that the heat sink is one which resists leakage even if punctured. The fluid within the heat sink can be water or other types of aqueous slurry, including water with adjuvant such as preservative. Preferably, the heat sink is flexible which provides ease of insertion into the sack 62.

The tote 10 additionally includes an adjustable strap 80 for ease of carrying. Preferably, the strap ends are attached to the top and side of the tote.

The heat sink 22 is preferably placed in a refrigerator until it becomes cold. At this point, it is generally provided at a temperature of between about 33° F. and about 36° F. The heat sink is then placed in the sack 62, and the beverage 20 in introduced into the beverage cooling compartment 12 which is then closed.

The detailed description of the invention is provided for illustration of a preferred embodiment of the invention and is not intended to limit the scope of the appended claims.

We claim:

1. A beverage cooling and carrying apparatus comprising:

a first compartment including an area constructed for receiving a bottle of wine and a heat sink along a length of the bottle of wine, and including a door for selective access to the first compartment, and wherein the first compartment includes insulation for decreasing the rate of heat transfer into the first compartment;

a second compartment for receiving drinking containers, wherein the second compartment includes cushioning material;

a strap attached to the apparatus for carrying the apparatus; and a heat sink provided within the first compartment and arranged for extending along at least a portion of a length of a bottle of wine, wherein the length of a bottle of wine extends from a top of the bottle of wine to a bottom of the bottle of wine.

2. A beverage cooling and carrying apparatus according to claim 1, wherein the heat sink is held within the first compartment by a sack.

3. A beverage cooling and carrying apparatus according to claim 1, wherein the sack comprises a mesh material.

4. A beverage cooling and carrying apparatus according to claim 3, wherein the second compartment comprises a baffle for separating the wine glasses.

5. A beverage cooling and carrying apparatus comprising:

a first compartment including an area constructed for receiving a beverage and a heat sink, said first compartment including a door for selective access to the area, insulation for decreasing the rate of heat transfer into the area, and a sack for containing a heat sink within the area and adjacent to a beverage;

a second compartment for receiving drinking containers;

a heat sink provided within the sack in the first compartment; and a strap attached to the apparatus for carrying the apparatus.

6. A beverage cooling and carrying apparatus according to claim 5, wherein the sack comprises a mesh material.

7. A beverage cooling and carrying apparatus according to claim 5, further comprising a beverage provided within the first compartment.

8. A beverage cooling and carrying apparatus according to claim 7, wherein the beverage comprises a bottle of wine.

9. A beverage cooling and carrying apparatus according to claim 5, further comprising drinking containers provided within the second compartment.

10. A beverage cooling and carrying apparatus according to claim 5, wherein the second compartment comprises wine glasses therein.

11. A beverage cooling and carrying apparatus according to claim 5, wherein the second compartment includes napkins therein.

12. A beverage cooling and carrying apparatus according to claim 5, wherein the second compartment includes a cork screw therein.

13. A beverage cooling and carrying apparatus according to claim 9, wherein the wine glasses are separated by a baffle.

14. A beverage cooling and carrying apparatus according to claim 1, wherein the drinking containers comprise wine glasses and are strapped in the second compartment.

15. A beverage cooling and carrying apparatus according to claim 1 wherein the second compartment includes napkins strapped therein.

16. A beverage cooling and carrying apparatus according to claim 1 wherein the second compartment includes a corkscrew strapped therein.

* * * * *